US006966315B2

(12) United States Patent
Pickering

(10) Patent No.: US 6,966,315 B2
(45) Date of Patent: Nov. 22, 2005

(54) SMOOTH SURFACE GAS COOKTOP HAVING AN ELECTRIC IGNITION/TURNDOWN SYSTEM

(75) Inventor: Mark A. Pickering, Cleveland, TN (US)

(73) Assignee: Maytag Corporation, Newton, IA (US)

( * ) Notice: Subject to any disclaimer, the term of this patent is extended or adjusted under 35 U.S.C. 154(b) by 22 days.

(21) Appl. No.: 10/603,752

(22) Filed: Jun. 26, 2003

(65) Prior Publication Data

US 2004/0261779 A1 Dec. 30, 2004

(51) Int. Cl.[7] ..... F24C 3/10
(52) U.S. Cl. ..... 126/39 E; 126/39 BA; 126/39 J
(58) Field of Search ..... 126/39 E, 39 BA, 126/41 R, 39 J, 39 K; 431/264, 258

(56) References Cited

U.S. PATENT DOCUMENTS

| | | | | |
|---|---|---|---|---|
| 1,716,329 A | | 6/1929 | Simpson | 126/39 R |
| 2,921,176 A | * | 1/1960 | Scofield | 431/258 |
| 3,275,497 A | | 9/1966 | Weiss et al. | 427/350 |
| 3,734,681 A | | 5/1973 | Perl | 126/39 J |
| 3,799,730 A | * | 3/1974 | Das et al. | 431/191 |
| 4,130,104 A | | 12/1978 | Kristen et al. | 126/39 J |
| 4,993,401 A | | 2/1991 | Diekmann et al. | 126/39 E |
| 5,016,608 A | * | 5/1991 | Evans | 126/41 R |
| 5,024,209 A | | 6/1991 | Schaupert | 126/39 H |
| 5,099,822 A | | 3/1992 | Cramer et al. | 126/39 BA |
| 5,329,918 A | | 7/1994 | Di Bari | 126/39 BA |
| 5,769,622 A | * | 6/1998 | Aoki et al. | 431/80 |
| 5,787,874 A | | 8/1998 | Krohn et al. | 126/39 BA |
| 6,349,174 B1 | * | 2/2002 | Ray et al. | 396/106 |
| 6,349,714 B1 | * | 2/2002 | Hurley et al. | 126/39 J |

FOREIGN PATENT DOCUMENTS

GB 1 426 123 A * 2/1976

* cited by examiner

*Primary Examiner*—Josiah C. Cocks
(74) *Attorney, Agent, or Firm*—Diederiks & Whitelaw, PLC

(57) ABSTRACT

A cooking appliance includes smooth cooking surface having at least one cooking zone, a base frame section, at least one gas burner assembly located between the smooth cooking surface and the base frame section, and a control unit. A wire filament coil, electrically interconnected to the control unit, is arranged adjacent to the gas burner assembly. The wire filament coil includes a plurality of distinct, independently controlled segments extending about a perimeter of the gas burner. When operated in a first mode, at least one segment of the wire filament coil is utilized as an ignition source for a gas flow directed from the gas burner assembly. When operated in a second mode, the gas flow is shut off and selected segments of the wire filament coil are activated to establish a low level heat setting for the cooking zone.

18 Claims, 2 Drawing Sheets

SMOOTH SURFACE GAS COOKTOP HAVING AN ELECTRIC IGNITION/TURNDOWN SYSTEM

BACKGROUND OF THE INVENTION

1. Field of the Invention

The present invention pertains to the art of cooking appliances and, more specifically, to a cooking appliance in the form of a smooth surface gas cooktop having a combination, electric ignition/turndown system.

2. Discussion of the Prior Art

In the art of cooking appliances it is known to provide a smooth cooking surface upon which a variety of cooking operations can be performed. Typically, the cooktop includes a plurality of independently controlled cooking or heating zones mounted upon an oven range or, alternatively, in a kitchen countertop, island assembly or the like. In general, arranged below each of the plurality of cooking zones is an associated heat source which, upon activation, transmits heat to the cooking surface for performing a selected cooking process. In most applications that utilize a smooth cooking surface, the heat source is a sheathed, resistive heating element of a type commonly used in electric cooking applications. However, manufacturers are producing "gas under glass" or smooth surface cooktops using gas as a heat source.

In contrast to electric heating elements, mounting gas burners below a smooth cooktop surface requires special design considerations. Namely, gas burners require an air in sufficient amounts to fully combust the available gas. Less than full combustion results in emissions that exceed accepted regulatory standards. Therefore, gas under glass systems generally operate with a forced combustion, induced draft system which burn with a clear flame. However, as the flame is in all accounts invisible, it is difficult for a consumer to determine when a particular burner is in operation. Accordingly, several manufactures include a wire filament or re-radiant coil mounted adjacent to the burner which, when heated, glows. In this manner, the consumer is provided with a visual indication that a particular cooking zone is activated. In addition to the re-radiant coil, manufactures may also include a temperature sensor which signals a control to provide an indication, such as by illuminating an LED, to the consumer that a particular burner is in operation or has recently been operated.

A more pronounced problem associated with gas under glass systems is maintaining stable performance at low gas input or turndown conditions. Since the gas burners operate with forced air combustion, maintaining an adequate fuel/air ratio at low heat levels is difficult. Typically, when low heat is selected, the flame can starve due to an insufficient supply of air. As a result, the consumer will be unable to reliably simmer or cook foods using a low heat setting. This can make the gas under glass arrangement unacceptable to most users. Therefore, based on at least these reasons, there exists a need in the art for a gas under glass cooktop capable of maintaining stable performance at low gas or turndown conditions.

SUMMARY OF THE INVENTION

The present invention is directed to a cooking appliance in the form of a gas cooktop. Specifically, the cooktop includes a smooth cooking surface having at least one cooking zone, a base frame section, at least one gas burner assembly located between the smooth cooking surface and the base frame section, and a control unit. More specifically, the at least one gas burner assembly is positioned to deliver heat energy, at a consumer selected temperature level, to the at least one cooking zone in order to perform a cooking process.

In accordance with a preferred embodiment of the present invention, a wire filament coil assembly, electrically interconnected to a control unit, is arranged adjacent to the gas burner assembly. Preferably, the wire filament coil assembly includes a plurality of distinct, independently controlled, segments extending about a peripheral portion of the gas burner. With this arrangement, upon initial activation of the gas burner assembly, the control unit activates at least one of the plurality of segments to ignite a gas flow emanating from the gas burner assembly.

In addition to acting as an ignition source for the gas burner assembly, the wire filament coil assembly can be selectively operated to establish a controlled, low temperature heat setting for the cooktop. If a simmer or low temperature setting is selected, the control unit deactivates the gas burner assembly by shutting off the supply of gas and, in turn, activates the wire filament coil assembly to generate a low temperature heat level which is directed upon the cooking zone. More specifically, the control unit can vary the selected low temperature by activating select ones of the wire filament coil assembly segments in order to achieve the desired temperature level.

In further accordance with the preferred embodiment, a re-radiant coil is arranged proximate to the gas burner assembly. More specifically, the re-radiant coil is located about a central peripheral portion of the gas burner bordering a plurality of gas discharge ports. In this manner, once the gas flow is ignited by the wire filament coil, heat produced by the burning gas impinges upon the re-radiant coil. The heat energy drives the re-radiant coil to a radiant temperature causing the coil to glow. By design, the glowing coil is visible through the cooking surface such that the consumer is provided with an indication that a particular burner is in operation.

Additional objects, features and advantages of the present invention will become more readily apparent from the following detailed description of a preferred embodiment when taken in conjunction with the drawings wherein like reference numerals refer to corresponding parts in the several views.

DETAILED DESCRIPTION OF THE PREFERRED EMBODIMENT

Figure 1:
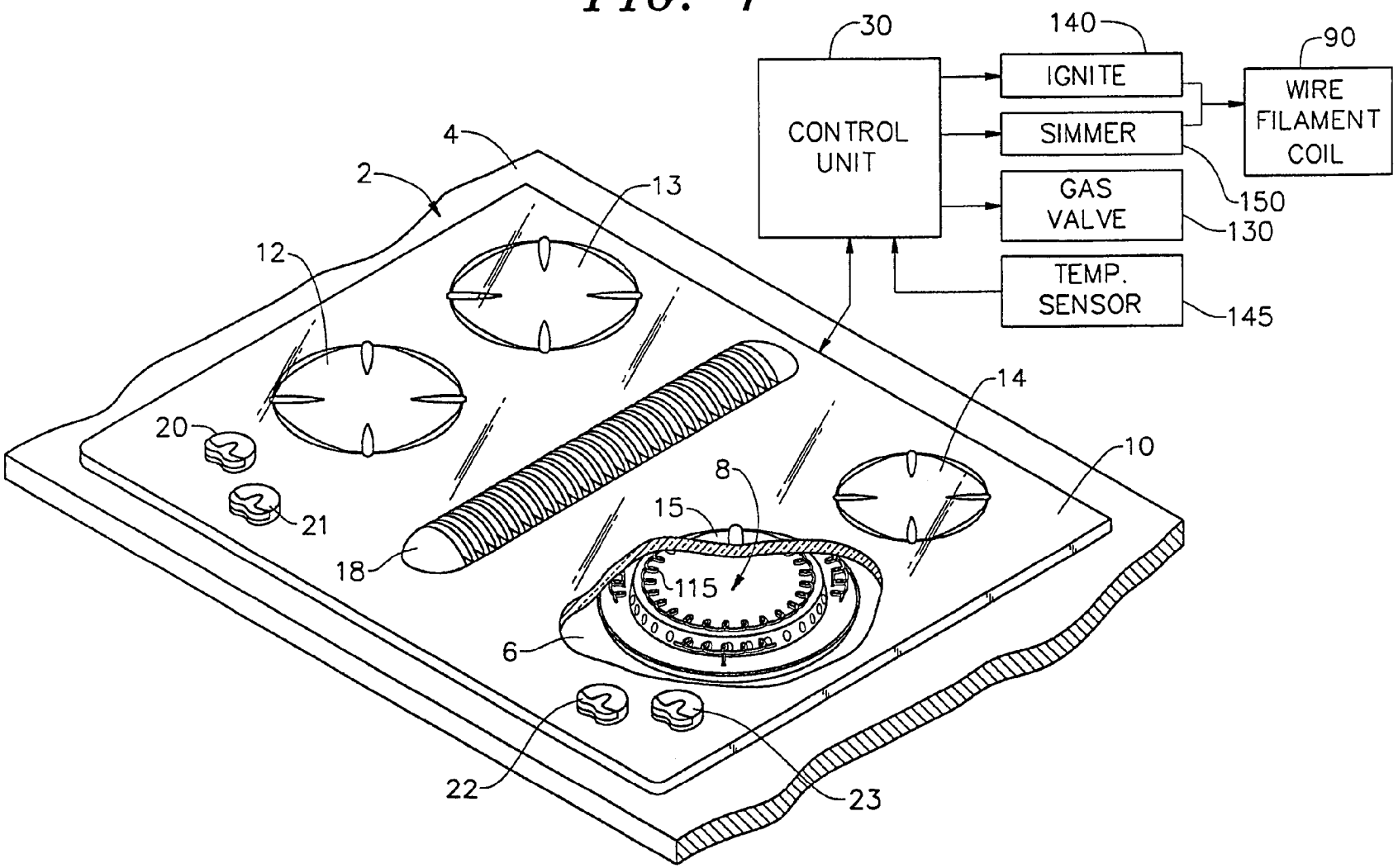
FIG. 1 is a perspective, partially cut-away view of a smooth surface cooktop employing a gas burner assembly including an electric ignition/turndown system constructed in accordance with the present invention.

With initial reference to FIG. 1, a cooking appliance constructed in accordance with the present invention is generally shown at 2. Although the actual cooking appliance into which the present invention may be incorporated can vary, the invention is shown in connection with cooking appliance 2 depicted as a cooktop mounted along a kitchen countertop 4. However, it should be understood that the present invention is not limited to this particular configuration and can be incorporated into various types of oven ranges, e.g., both free-standing and slide-in ranges and the like. In the embodiment shown, cooking appliance 2 includes a base frame member 6 having arranged thereon a plurality of gas burner assemblies, one of which is indicated generally at 8, and a smooth, glass-ceramic cooking surface 10. In the embodiment shown, an array of cooking zones 12–15, which are represented by grate indicia, are positioned about cooking surface 10 above each associated burner assembly 8.

In a manner known in the art, a downdraft fan unit 18 is centrally positioned upon cooking surface 10 between the array of cooking zones 12–15. In general, downdraft fan unit 18 is provided to remove smoke and/or other food affluents generated during a cooking process. As further shown in FIG. 1, cooking appliance 2 includes a plurality of control knobs 20–23, each associated with a respective one of the plurality of cooking zones 12–15. In the embodiment shown, control knobs 20–23 establish, in combination with a control unit 30, particular temperature settings for each of the corresponding cooking zones 12–15.

Figure 2:
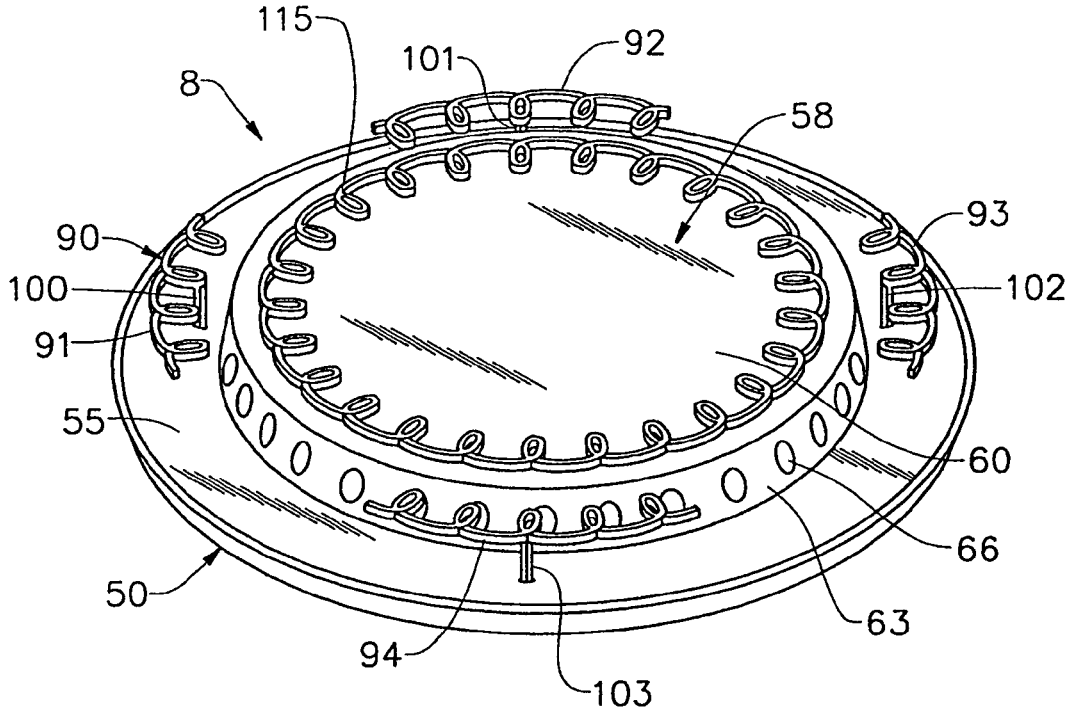
FIG. 2 is a perspective view of the gas burner assembly and electric ignition/turndown system of FIG. 1.
Figure 3:
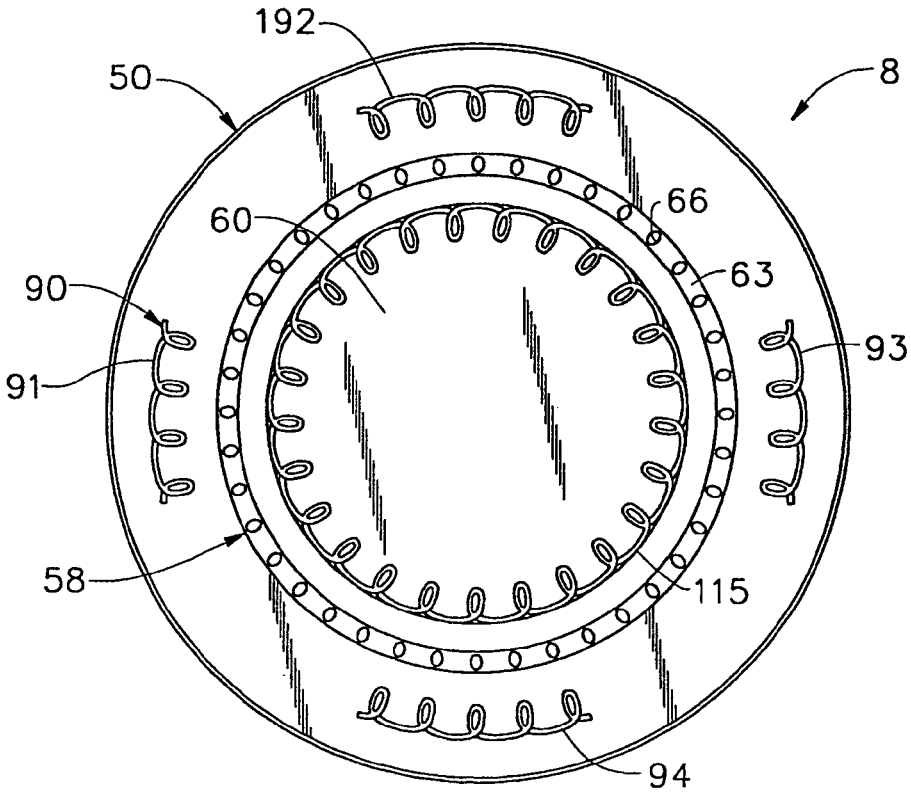
FIG. 3 is a top elevational view of the gas burner assembly and electric ignition/turndown system of FIG. 2.

As best seen in FIGS. 2 and 3, gas burner assembly 8 includes a burner element 50 having a base portion 55 and a central discharge element 58. In the embodiment shown, central discharge element 58 includes a top portion 60 and a peripheral side portion 63 having provided thereabout a plurality of gas discharge or outlet ports, one of which is indicated at 66. In accordance with the preferred embodiment of the present invention illustrated in these figures, a wire filament coil assembly 90 extends about a peripheral portion of central discharge element 58. More specifically, wire filament coil assembly 90 is preferably constituted by a plurality of segments 91–94, each of which is independently interconnected with control unit 30 through a plurality of associated leads 100–103.

In further accordance with the preferred embodiment, a re-radiant coil 115, preferably formed from Kanthal wire, is located about top portion 60 of central discharge element 58. With this arrangement, flames generated by gas burner assembly 8 will heat and drive re-radiant coil 115 to a radiant temperature. As re-radiant coil 115 reaches the radiant temperature, re-radiant coil 115 is caused to glow, thus providing a visual indication through cooking surface 10 to the consumer that a particular cooking zone 12–15 is active.

Having described a preferred construction of the present invention, reference will now be made to FIGS. 1–3 in describing a preferred method of operation. In order to initiate a cooking process, a consumer manipulates one of the plurality of control knobs 20–23 to select a desired temperature setting. Initially, upon receiving a signal from a respective one or more of control knobs 20–23, control unit 30 operates a gas valve 130 which permits a gas flow to be directed to the gas burner assembly(s) 8 corresponding to the control knob(s) 20–23 chosen. Concurrently, control unit 30 activates an ignition module or igniter 140 which applies an electrical current to wire filament coil assembly 90 in order to ignite the gas flow.

In the most preferred form of the invention, ignition module 140 need only apply the electrical current to one of the segments 90–94 of wire filament coil assembly 90 for ignition purposes. Once the gas flow has been ignited, a temperature sensor 145 signals control unit 30 to cease operation of ignition module 140. However, if temperature sensor 145 does not sense a rise in temperature at the corresponding gas burner assembly 8, control unit 30 establishes a fault condition, closes gas valve 130 to prevent gas from flowing into habitable areas of the consumer's home or cooking area.

Once the gas flow has been ignited, the consumer controls the temperature of the associated cooking zone 12–15 by manipulating the respective one of the plurality of control knobs 20–23. In this manner, the consumer can increase or decrease the gas flow resulting in a corresponding temperature change at the respective cooking zone 12–15. However, at low or simmer temperatures, it can be difficult to maintain ignition of the gas flow. That is, there is a tendency for the flame to suffocate and shut down at low settings. Consequently, if the consumer desires to perform a simmer or low temperature cooking process, control unit 30 closes gas valve 130 ceasing operation of the respective gas burner assembly 8 and, in turn, activates a simmer module 150. In accordance with the most preferred embodiment, simmer module 150 applies an electrical current to wire filament coil assembly 90. Upon activation, the temperature of wire filament coil assembly 90 provides radiant heat at a low temperature to a corresponding cooking zone 12–15. More specifically, as each of the plurality of segments 91–94 of wire filament coil assembly 90 are independently connected to simmer module 150 through control unit 30, simmer module 150 can selectively activate one or more of segments 91–94 to operate the cooking zone within a desired temperature range. In the most preferred form of the invention, each of segments 91–94 is adapted to generate 40 watts of power such that simultaneous activation of all four segments 91–94 will fall within the limit of a 15 amp branch circuit typically associated with a power supply for a gas residential cooking appliance. In any case, with this overall arrangement, the consumer can operate cooking appliance 2 over a wide range of temperatures without sacrificing low temperature performance.

Although described with reference to a preferred embodiment of the present invention, it should be readily apparent of one of ordinary skill in the art that various changes and/or modifications can be made to the invention without departing from the spirit thereof. For instance, while the current invention illustrates four separate coil segments 91–94 extending about each burner assembly 8, it should be understood that the number of segments could be readily varied from a single coil to a greater number of segments. In addition, the segments 91–94 need not actually take the form of coils, but rather could take a variety of configurations. In general, the invention is only intended to be limited to the scope of the following claims.

I claim:

1. A cooking appliance comprising:

a cooktop including a cooking surface having a substantially smooth upper surface with at least one cooking zone being arranged thereon;

at least one gas burner assembly arranged below the upper surface of the cooktop, said gas burner assembly being adapted to selectively establish a first heat energy source for heating the at least one cooking zone to a cooking temperature;

a wire filament arranged adjacent to the at least one gas burner assembly; and a control unit electrically interconnected to the wire filament through simmer circuitry, said control unit being adapted to activate the wire filament in a first mode, wherein electrical energy is momentarily supplied to the wire filament to ignite a flow of gas emanating from the gas burner assembly, and in a second mode, wherein the electrical energy is supplied to the wire filament coil through the simmer circuitry in the absence of the flow of gas to establish a second heat energy source for heating the at least one cooking zone to a temperature below the cooking temperature.

2. The cooking appliance according to claim 1, wherein the wire filament is formed from a plurality of segments, each of said plurality of segments being independently interconnected with the control unit.

3. The cooking appliance according to claim 2, wherein the control unit can activate each of the plurality of segments independently or concurrently.

4. The cooking appliance according to claim 3, wherein the control unit activates only one of the plurality of segments to ignite the flow of gas.

5. The cooking appliance according to claim 4, wherein the filament includes four segments arranged about a perimeter of the gas burner assembly.

6. The cooking appliance according to claim 5, wherein each of the four segments operates on 40 watts of electrical energy.

7. The cooking appliance according to claim 1, further comprising: a re-radiant coil arranged proximate to the gas burner assembly, said re-radiant coil being adapted to be driven to radiant temperatures by the ignited flow of gas.

8. A cooking appliance comprising:

a cooktop including a cooking surface having a substantially smooth upper surface with at least one cooking zone being arranged thereon;

at least one gas burner assembly arranged below the upper surface of the cooktop, said gas burner assembly being adapted to selectively establish a first heat energy source for heating the at least one cooking zone to a cooking temperature;

a re-radiant coil positioned about the at least one gas burner assembly, said re-radiant coil being adapted to be driven to radiant temperatures by the first heat energy source;

a wire filament arranged adjacent to the at least one gas burner assembly; and simmer circuitry operatively connected to the wire filament, wherein the wire filament can both ignite a gas flow emanating from the at least one gas burner assembly and, through the simmer circuitry, serve as a second heat energy source in the absence of the first heat energy source to heat the at least one cooking zone to a temperature below the cooking temperature.

9. The cooking appliance according to claim 8, further comprising: a control unit electrically interconnected to the wire filament, said control unit being adapted to selectively activate the wire filament during particular cooking operations.

10. The cooking appliance according to claim 9, wherein the wire filament is formed from a plurality of segments, each of said plurality of segments being independently interconnected with the control unit.

11. The cooktop according to claim 10, wherein the control unit can activate each of the plurality of segments independently or concurrently.

12. The cooktop according to claim 10, wherein one of the plurality of segments is adapted to selectively ignite the gas flow.

13. The cooktop according to claim 12, wherein the wire filament includes four segments arranged about a perimeter of the gas burner assembly.

14. The cooking appliance according to claim 13, wherein each of the four segments operates on 40 watts of electrical energy.

15. A method of operating a smooth-surface cooktop comprising:

operating at a high temperature by:

opening a gas valve to send a flow of gas to a gas burner assembly arranged below a cooking zone defined by the smooth-surface cooktop;

igniting the flow of gas by momentarily activating at least a portion of a wire filament arranged about the gas burner assembly; and heating the cooking zone to the high temperature through heat emanating from the gas burner assembly; and operating at a low temperature by:

activating the wire filament while maintaining the gas flow deactivated, to heat the cooking zone to the low temperature.

16. The method of claim 15, wherein operating at the high temperature further includes driving a re-radiant coil arranged about the gas burner assembly to radiant temperatures to visually indicate that the gas burner assembly is in operation.

17. The method of claim 15, wherein operating at the low temperature further includes activating a plurality of wire filament segments arranged about the gas burner assembly.

18. The method of claim 16, further comprising: selectively operating the plurality of wire filament segments independently or concurrently.

* * * * *